US005301956A

United States Patent [19]

Sanchez Hernandez

[11] Patent Number: 5,301,956

[45] Date of Patent: Apr. 12, 1994

[54] ACTIVITY GAME APPARATUS

[76] Inventor: Jose M. Sanchez Hernandez, Antonio Cardenas No. 337, Col. Heroes de Churubusco Mexico 13, DF C.P. 09090, Mexico

[21] Appl. No.: 824,363

[22] Filed: Jan. 23, 1992

[51] Int. Cl.[5] ..... A63F 9/00

[52] U.S. Cl. ..... 273/429

[58] Field of Search ..... 273/429, 272

[56] References Cited

U.S. PATENT DOCUMENTS

| | | | |
|---|---|---|---|
| 3,797,826 | 3/1974 | Horner | 273/429 |
| 4,789,162 | 12/1988 | Harris | 273/272 |
| 4,928,976 | 5/1990 | Vano et al. | 273/272 X |
| 4,934,711 | 6/1990 | Runstein | 273/272 |
| 4,944,519 | 7/1990 | Canela | 273/272 X |

*Primary Examiner*—William H. Grieb

*Attorney, Agent, or Firm*—Leon Gilden

[57] ABSTRACT

A game apparatus including a support housing to include a timer member, an audio cassette record and playback device, and a microphone, the microphone arranged for electrical communication with the audio cassette device, as well as a plurality of activity cards and an activity card interpretation book. A player selects an individual card from the activity cards and the activity is thusly interpreted by an arbitrary judge to direct a moving player to perform a predetermined activity directed by the cards. Judging is effected by the judge or an arbitrary panel of players to gauge success of the activity effected by the moving player. A modification of the invention includes an oral impediment arranged for utilization by a player to create difficulty in recreating the activity thusly chosen.

4 Claims, 4 Drawing Sheets

ACTIVITY GAME APPARATUS

BACKGROUND OF THE INVENTION

1. Field of the Invention

The field of invention relates to game apparatus, and more particularly pertains to a new and improved activity game apparatus wherein the same is arranged to direct players to recreate various activities.

2. Description of the Prior Art

Game apparatus of various types are utilized throughout the prior art employed by individuals to direct the individuals in the amusement and enjoyment of various events and participating in game play. Game apparatus of various types are exemplified in U.S. Pat. No. 4,789,162 to Harris utilizing a word and message forming game; U.S. Pat. No. 4,944,519 to Canela to effect a game for memorizing messages, slogans, and phrases; U.S. Pat. No. 4,934,711 to Runstein sets forth a word and category association game; and U.S. Pat. No. 4,928,976 to Vano, et al. sets forth a word and question association type game.

As such, it may be appreciated that there continues to be a need for a new and improved activity game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of game apparatus now present in the prior art, the present invention provides an activity game apparatus wherein the same is arranged to direct players to recreate various activities in play of the game. As such, the general purpose of the present invention, which will be described subsequently in greater detail, is to provide a new and improved activity game apparatus which has all the advantages of the prior art game apparatus and none of the disadvantages.

To attain this, the present invention provides a game apparatus including a support housing to include a timer member, an audio cassette record and playback device, and a microphone, the microphone arranged for electrical communication with the audio cassette device, as well as a plurality of activity cards and an activity card interpretation book. A player selects an individual card from the activity cards and the activity is thusly interpreted by an arbitrary judge to direct a moving player to perform a predetermined activity directed by the cards. Judging is effected by the judge or an arbitrary panel of players to gauge success of the activity effected by the moving player. A modification of the invention includes an oral impediment arranged for utilization by a player to create difficulty in recreating the activity thusly chosen.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved activity game apparatus which has all the advantages of the prior art game apparatus and none of the disadvantages.

It is another object of the present invention to provide a new and improved activity game apparatus which may be easily and efficiently manufactured and marketed.

It is a further object of the present invention to provide a new and improved activity game apparatus which is of a durable and reliable construction.

An even further object of the present invention is to provide a new and improved activity game apparatus which is susceptible of a low cost of manufacture with regard to both materials and labor, and which accordingly is then susceptible of low prices of sale to the consuming public, thereby making such activity game apparatus economically available to the buying public.

Still yet another object of the present invention is to provide a new and improved activity game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
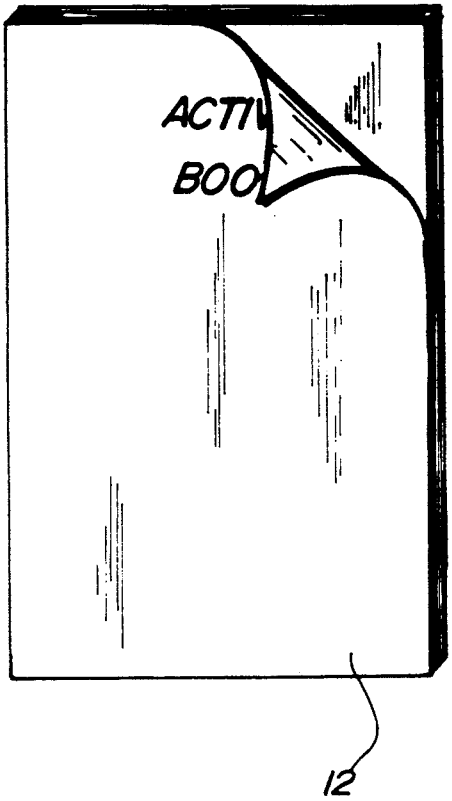
FIG. 1 is an isometric illustration of an activity interpretation book utilized by the invention.
Figure 2:
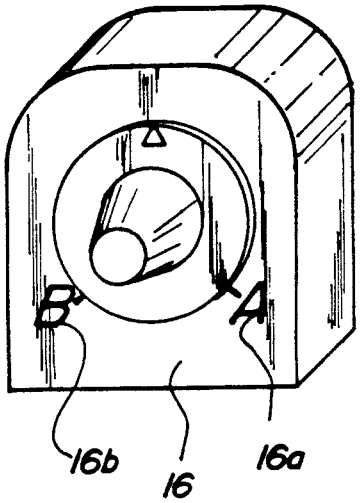
FIG. 2 is an isometric illustration of a time member utilized by the invention.
Figure 3:
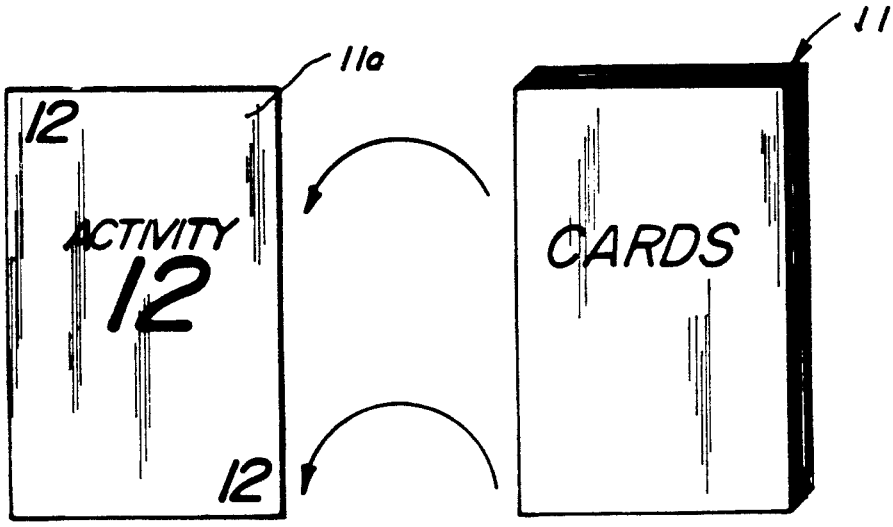
FIG. 3 is an isometric illustration of a card selected from an activity card deck utilized by the invention.
Figure 4:
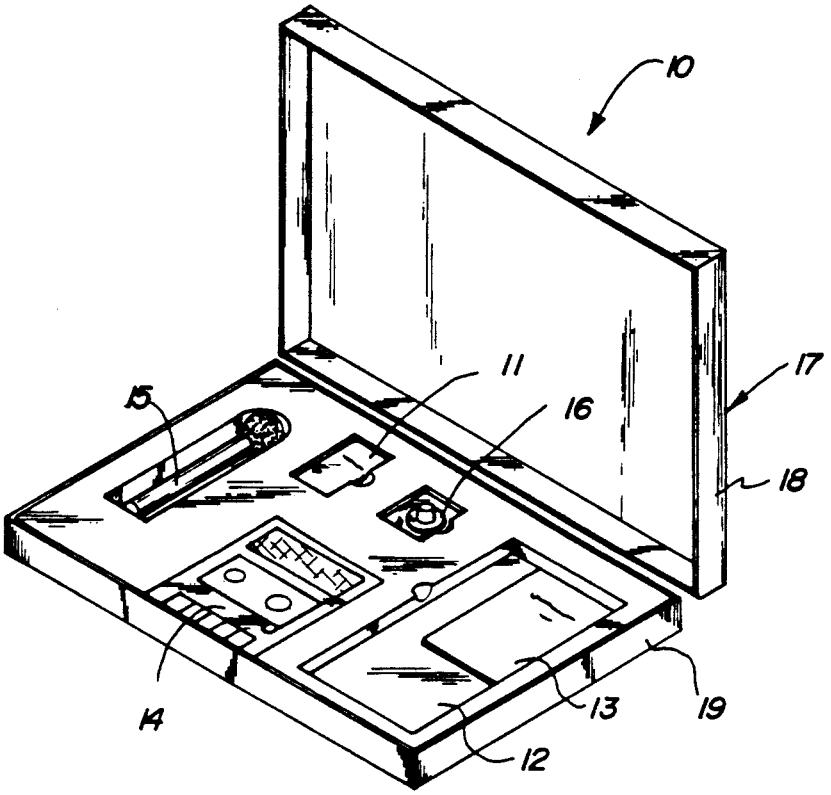
FIG. 4 is an isometric illustration of an activity game in an assembled configuration.

With reference now to the drawings, and in particular to FIGS. 1 to 9 thereof, a new and improved activity game apparatus embodying the principles and concepts of the present invention and generally designated by the reference numerals 10 and 10*a* will be described.

More specifically, the activity game apparatus 10 of the instant invention essentially comprises the use of a card deck 11 (see FIG. 3) employing various individual activity cards 11*a*, wherein each activity card is associated with a designated numeral on a bottom side thereof. Upon selection of an activity card 11*a* by a player of a plurality of players, an arbitrary judge preselected by the players and not participating in selection of the activity cards is directed to an interpretation book 12 to interpret the activity required by the associated numeral. For example, the numeral 12 may involved the singing of a preselected popular song and the like. It should be further noted that various arbitrary activities may be employed and various designations of enumeration may be directed to a selection of a plurality of activities to be decided upon by the associated predetermined judge. An audio cassette record and playback device 14 is provided and mounted within the support case 17 of a type such as illustrated in the FIG. 4, as well as a timer 16 to afford each player a predetermined time for completion of a predetermined activity. The timer is provided with a degree of difficulty and to provide for a first time period 16*a* or a second time period 16*b*. The time period may be further determined by the selection of a time available card 20 from the deck, such as illustrated in the FIG. 6, and may be further utilized in a modification of the invention to assist a degree of difficulty in use of an oral impediment member 25 as an optional employment of structure by the invention. The support case 17 is provided with a lid 18 pivotally mounted to the base 19.

Figure 5:
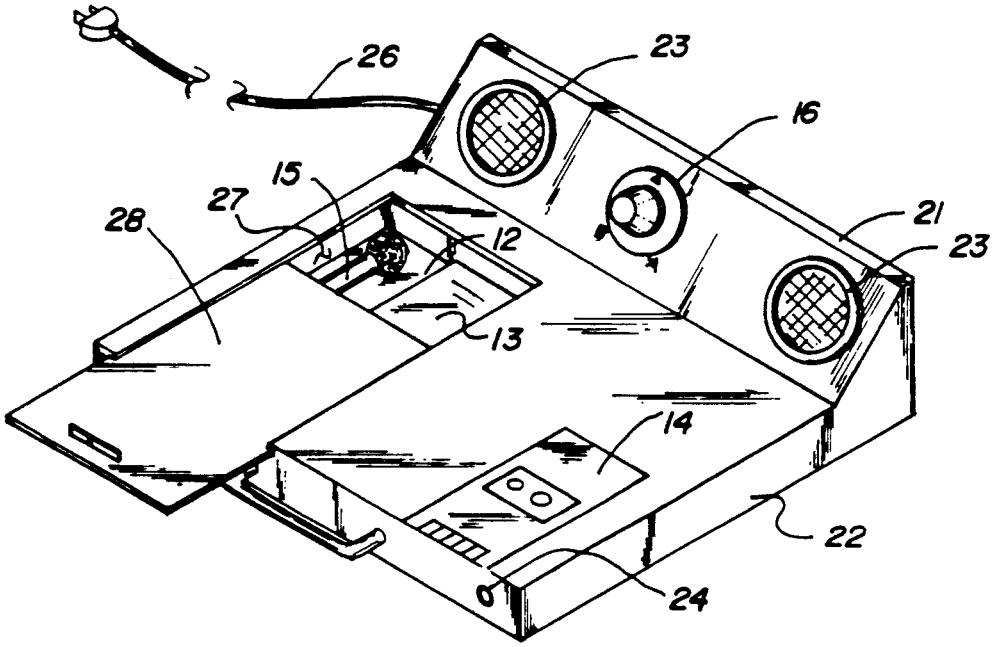
FIG. 5 is an isometric illustration of a modified activity game support utilized by the invention.
Figure 6:
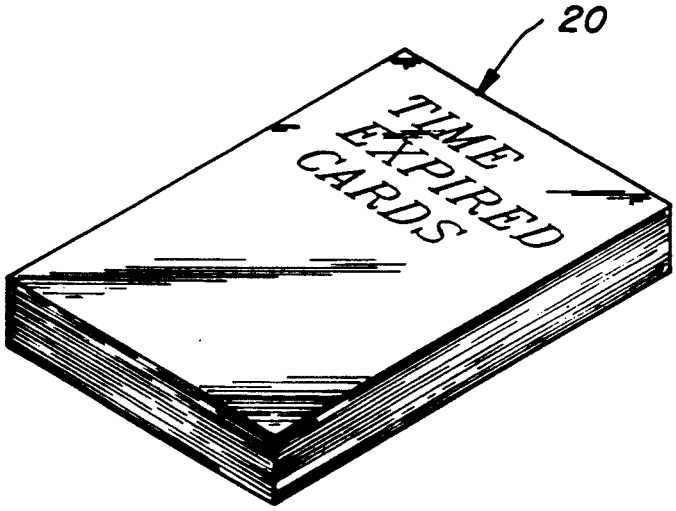
FIG. 6 is an isometric illustration of time cards and difficulty cards utilized by the invention.
Figure 7:
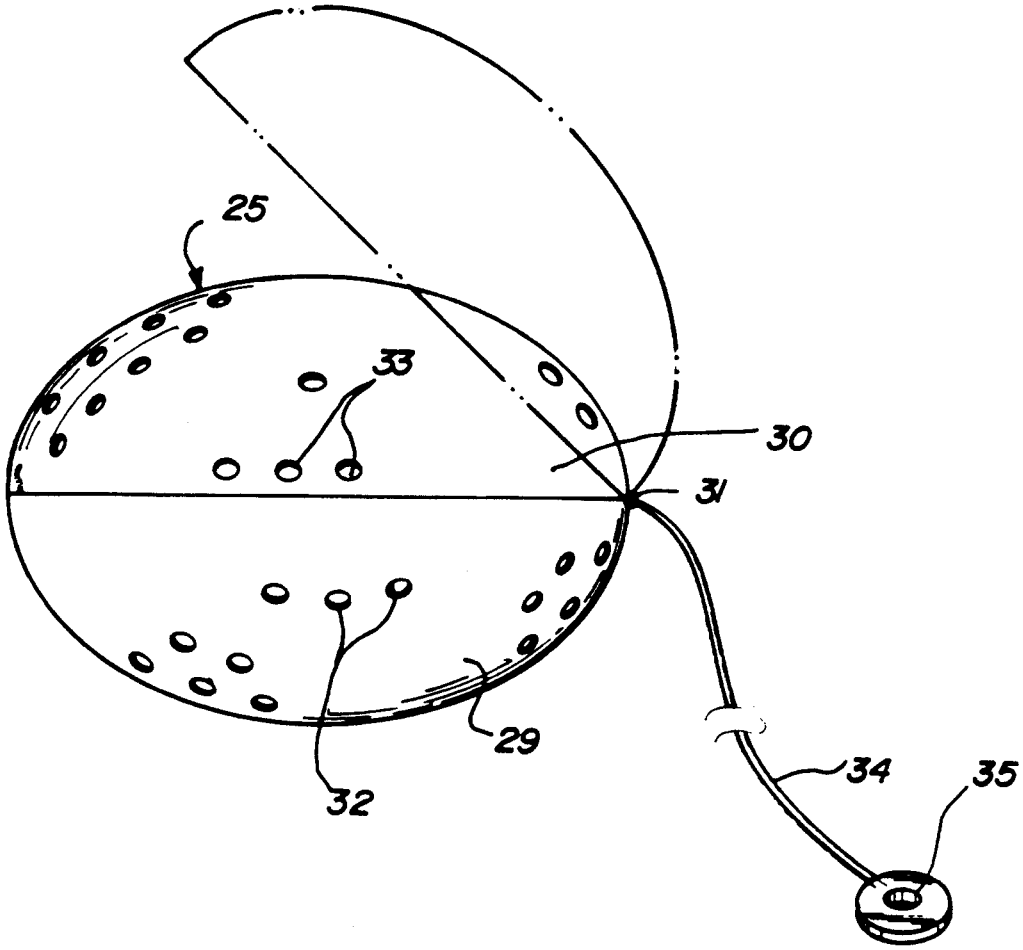
FIG. 7 is an isometric illustration of oral impediment member utilized by the invention.
Figure 8:
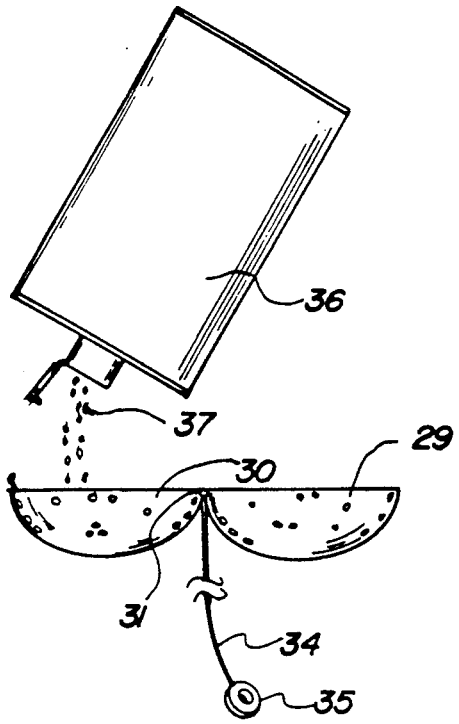
FIG. 8 is an orthographic view, taken in elevation, of the oral impediment member employing an associated flavoring therewithin.
Figure 9:
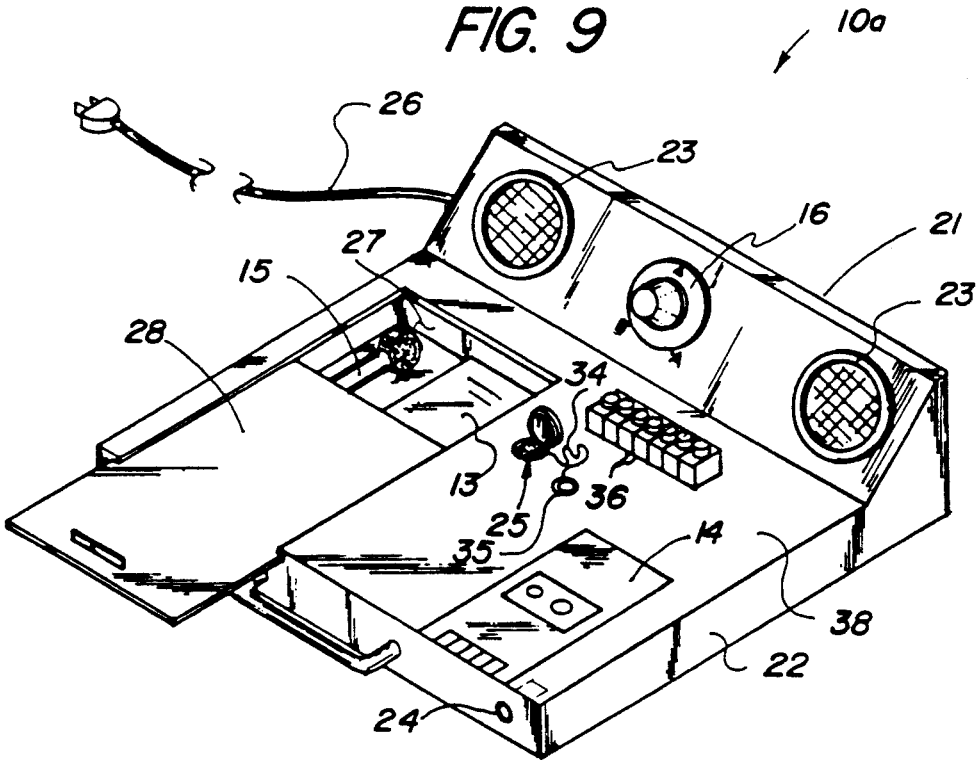
FIG. 9 is an isometric illustration of the modified game apparatus in an assembled configuration.

A modified case structure is illustrated in the FIG. 5 to include a support case rear flange extending upwardly relative to a support case base 22. Audio speakers 23 in operative association with the audio record and playback device 14 mounted within the base 22 is operative to enhance audio projection of an event or activity undertaken by a moving player selecting an activity card 11*a*. A microphone 15 is employed with a microphone input socket 24 to direct play into the audio cassette playback device for subsequent replay by individuals. As illustrated, electrical power supply cord 26 is in operative association with the audio cassette record and playback device 14 and may be employed as well with alternatively battery power, as is available to drive various electronic devices.

Further, a storage compartment cavity 27 is provided within the base 22 utilizing a door plate 28 to afford protection to the microphone member mounted therewithin. As illustrated, the audio cassette record and playback device 14 is mounted within the base 22 for affording protection. A handle is mounted fixedly to a forward end wall of the base 22 for ease of transport and manual manipulation of the device.

The oral impediment member 25 includes a first elliptical shell 29 cooperative with a mirror image second elliptical shell 30 pivotally mounted by the hinge 31. First and second respective apertures 32 and 33 are directed through the first and second elliptical shells 29 and 30 respectively, with a tether line 34 mounted to the hinge, with a remote distal end of the tether line terminating in securement to a magnet 35 that is mounted to a ferrous base top wall 38 of the base 22 to tether an individual relative to the top wall 38 for enhance difficulty in effecting utilization of the apparatus. A plurality of canisters 36 each include a variously flavored powder 37 therewithin that is positioned within the shells 29 and 30 when secured together to meter dispensing of the powder through the apertures 32 and 33 to further provide difficulty in effecting an activity directed by the interpretation book 12. A player must successfully repeat an activity as directed by the interpretation book 12 and in an available time frame as directed by the time available cards 20 in an associated degree of difficulty, as well as in use of the oral impediment member 25, is declared a winner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An activity game apparatus arranged to direct an individual player of a plurality of individual players to recreate a predetermined activity, wherein the apparatus comprises, a support case base, the support case base including a rear flange mounted to the support case base, wherein the flange includes a timer mechanism mounted therewithin, the timer mechanism including a first position and a second position, and an audio cassette record and playback device mounted within the support case base, and a microphone socket mounted to the case in operative association with the audio cassette record and playback device, and a microphone arranged for electrical communication to the microphone input socket, and a card deck of a plurality of individual activity cards, each activity card includes a predetermined designation mounted to a bottom surface of each card, and an interpretation book arranged for interpretation of the designation upon selection of an activity card of said activity card deck by one of said individual players, and at least one audio speaker mounted within the flange in operative association with the audio cassette record and playback device to permit recording and subsequent playback of an audio activity directed through the microphone into the audio cassette record and playback device.

2. An apparatus as set forth in claim 1 including a plurality of time available cards to direct said player of a plurality of individual players a predetermined time to be directed to the timer in effecting of an activity of a selected activity card, and wherein the time available cards further direct a degree of difficulty in effecting actuation of the activity.

3. An apparatus as set forth in claim 2 including a storage compartment cavity mounted within the support case base, wherein the cavity includes a door plate selectively mounted overlying the cavity to receive the microphone therewithin for storage during use.

4. An apparatus as set forth in claim 3 including an oral impediment member positioned upon the storage case base, the oral impediment member including a first shell hingedly mounted to a second shell about the hinge member, and a tether line mounted to the hinge member at first terminal end of the tether line, and a second terminal end of the tether line mounted to a magnet, and the support case base including a ferrous top wall for receiving the magnet thereto, and a plurality of canisters, the canisters including flavored powders contained therewithin for directing into the first and second elliptical shell for directing an individual into one of said individual players during actuation of an activity directed by said activity card to enhance a degree of difficulty in creating said activity as directed by one of said time available cards.

* * * * *